US008816261B1

(12) United States Patent
Blake et al.

(10) Patent No.: US 8,816,261 B1
(45) Date of Patent: Aug. 26, 2014

(54) BANG-BANG CONTROL USING TANGENTIALLY MOUNTED SURFACES

(75) Inventors: Jesse H. Blake, Tucson, AZ (US); Matthew G. Murphy, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 714 days.

(21) Appl. No.: 13/171,816

(22) Filed: Jun. 29, 2011

(51) Int. Cl.

| | |
|---|---|
| ***F42B 10/62*** | (2006.01) |
| ***F42B 15/01*** | (2006.01) |
| *F42B 10/00* | (2006.01) |
| *F42B 15/00* | (2006.01) |

(52) U.S. Cl.
USPC ..... 244/3.24; 244/3.1; 244/3.15; 244/3.16; 244/3.19; 102/501

(58) Field of Classification Search
USPC ..... 244/3.1–3.3; 89/1.11, 1.1; 102/382, 102/384, 385, 473, 501; 701/400, 408, 468
See application file for complete search history.

(56) References Cited

U.S. PATENT DOCUMENTS

| | | | | | |
|---|---|---|---|---|---|
| 2,923,241 | A | * | 2/1960 | House | 244/3.29 |
| 2,977,880 | A | * | 4/1961 | Kershner | 244/3.29 |
| 3,063,375 | A | * | 11/1962 | Hawley et al. | 244/3.27 |
| 3,114,287 | A | * | 12/1963 | Swaim | 244/3.28 |
| 3,125,956 | A | * | 3/1964 | Kongelbeck | 244/3.29 |
| 3,127,838 | A | * | 4/1964 | Moratti et al. | 244/3.27 |
| 3,165,281 | A | * | 1/1965 | Gohlke | 244/3.29 |
| 3,260,205 | A | * | 7/1966 | Dietrich | 244/3.23 |
| 3,273,500 | A | * | 9/1966 | Kongelbeck | 244/3.28 |
| 3,602,459 | A | * | 8/1971 | Pesarini et al. | 244/3.27 |
| 3,690,595 | A | * | 9/1972 | Rusbach | 244/3.27 |
| 3,702,588 | A | * | 11/1972 | Simmons | 244/3.29 |
| 3,819,132 | A | * | 6/1974 | Rusbach | 244/3.28 |
| 3,853,288 | A | * | 12/1974 | Bode | 244/3.29 |
| 4,044,970 | A | * | 8/1977 | Maudal | 244/3.22 |
| 4,323,208 | A | * | 4/1982 | Ball | 244/3.28 |
| 4,327,886 | A | * | 5/1982 | Bell et al. | 244/3.29 |
| 4,373,688 | A | * | 2/1983 | Topliffe | 244/3.24 |
| 4,588,146 | A | * | 5/1986 | Schaeffel et al. | 244/3.27 |
| 4,607,810 | A | * | 8/1986 | Frazer | 244/3.29 |
| 4,659,036 | A | * | 4/1987 | Pinson | 244/3.22 |
| 4,664,339 | A | * | 5/1987 | Crossfield | 244/3.28 |
| 4,673,146 | A | * | 6/1987 | Inglis | 244/3.23 |
| 4,778,127 | A | * | 10/1988 | Duchesneau | 244/3.29 |
| 4,884,766 | A | * | 12/1989 | Steinmetz et al. | 244/3.27 |
| 4,955,558 | A | * | 9/1990 | Machell et al. | 244/3.22 |
| 4,979,876 | A | * | 12/1990 | Chapman | 244/3.29 |
| 5,207,397 | A | * | 5/1993 | Ng et al. | 244/3.29 |
| 5,240,203 | A | * | 8/1993 | Myers | 244/3.28 |
| 5,282,588 | A | * | 2/1994 | August | 244/3.3 |
| 5,326,049 | A | * | 7/1994 | Rom et al. | 244/3.28 |
| 5,398,887 | A | * | 3/1995 | Wassom et al. | 244/3.22 |

(Continued)

*Primary Examiner* — Bernarr Gregory
(74) *Attorney, Agent, or Firm* — Renner, Otto, Boisselle & Sklar, LLP

(57) ABSTRACT

Control surfaces secured tangentially to a round projectile, such that the lift force generated by the control surfaces is generated through the projectiles centerline. This eliminates the need for an opposing fin to counter roll moment. Sizing the control surfaces to form an equilateral triangle gives each panel equal span, and enables the force generated by two panels to be equal and opposite to that of the opposing panel. The end effect is that each panel only has two active states (neutral and positive deflection). Thus, a solenoid and a return spring may be used to control the canards. Additionally, the control panels may fold along the surface of the projectile, which frees up internal volume and minimizes the length of the control section.

23 Claims, 6 Drawing Sheets

(56) References Cited

U.S. PATENT DOCUMENTS

| | | | | |
|---|---|---|---|---|
| 5,480,111 | A | 1/1996 | Smith et al. | |
| 6,502,786 | B2 * | 1/2003 | Rupert et al. | 244/3.27 |
| 6,511,016 | B2 * | 1/2003 | Bar et al. | 244/3.24 |
| 6,666,402 | B2 * | 12/2003 | Rupert et al. | 244/3.27 |
| 6,869,044 | B2 | 3/2005 | Geswender et al. | |
| 6,905,093 | B2 * | 6/2005 | Dryer et al. | 244/3.28 |
| 7,175,131 | B2 * | 2/2007 | Dodu et al. | 244/3.24 |
| 7,185,844 | B2 | 3/2007 | Yanushevsky | |
| 7,185,847 | B1 * | 3/2007 | Bouchard et al. | 244/3.28 |
| 7,628,353 | B2 * | 12/2009 | Peterson | 244/3.28 |
| 7,659,494 | B2 | 2/2010 | Lindgren | |
| 7,728,266 | B2 * | 6/2010 | Melkers et al. | 244/3.27 |
| 7,773,202 | B2 | 8/2010 | Crawford et al. | |
| 7,781,709 | B1 | 8/2010 | Jones et al. | |
| 7,952,055 | B2 * | 5/2011 | Turner et al. | 244/3.28 |
| 8,669,506 | B2 * | 3/2014 | Funis et al. | 244/3.29 |
| 2003/0018400 | A1 | 1/2003 | Tuttle et al. | |
| 2004/0041059 | A1 | 3/2004 | Kennedy et al. | |
| 2010/0231284 | A1 | 9/2010 | Jacobson et al. | |

* cited by examiner

BANG-BANG CONTROL USING TANGENTIALLY MOUNTED SURFACES

TECHNICAL FIELD

The present invention relates generally to a system and method for bang-bang control for a guided projectile and, more particularly to a system and method for generating equally spaced resultant force vectors using a bang-bang control actuation system with a plurality of control surfaces mounted tangentially around a surface of the projectile.

BACKGROUND OF THE INVENTION

Laser-guided projectiles generally use a laser illuminator to mark (e.g., illuminate, "paint", etc.) a target. The reflected laser light from the target is then detected by the seeker head of the weapon, which sends signals to the weapon's control fins to guide the weapon toward the designated target. Global positioning system (GPS) guided projectiles generally rely on GPS or other location based satellites to guide the GPS-guided projectile to the designated target. It is common for laser-guided projectiles and GPS-guided projectiles to include advanced control and actuation systems to direct the laser-guided projectile to the desired target. Such advanced control and actuation systems substantially increase the complexity of such devices, as well as the costs associated with such devices.

SUMMARY OF THE INVENTION

Several challenges exist with implementing a small form factor projectile having a limited engagement range. Such challenges include small form factor components and minimizing costs. It is difficult to utilize such advanced control and actuation systems in a small form factor in a low cost projectile. A 3-axis proportional control actuation system is bulky, as it requires 3 motors, gear trains, and canard storage, for example. Such a system is also expensive as it requires micro machined parts, close tolerances, and a high part count, which may be considered overkill for a near-ballistic flight.

Aspects of the present invention overcome the problems identified above by placing control surfaces (e.g., canards) on a plane that is tangent to the round projectile, such that the lift force generated by the canards is generated through a center-line axis of the projectile. This eliminates the need for an opposing fin to counter roll moment. Sizing the control surfaces to form an equilateral triangle gives each surface equal span, and enables the force generated by two panels to be equal and opposite to that of the opposing panel. The end effect is that each panel only has two active states (neutral (0 deflection) and positive deflection), (neutral (0 deflection) and negative deflection) or (positive deflection and negative deflection. Thus, a solenoid and a return spring (or other return mechanism) may be used to control deflection of the control surfaces. Additionally, the control surfaces may fold along the surface of the projectile, which frees up internal volume and minimizes the length of the control section.

One aspect of the invention relates to a guided projectile including: a body having a circular cross-section in at least a portion of the body; a plurality of actuators housed at least partially within the body; a plurality of control surfaces, wherein each control surface is secured to one of the plurality of actuators and the plurality of control surfaces are tangentially mounted about the cross-section of the body and each of the actuators are configured to impart a positive deflection on one of the control surfaces; a receiver housed within the head portion to for guiding the guided projectile, wherein the receiver outputs information related to a relative position between the guided projected and an associated target; and a processor coupled to the seeker and the plurality of actuators, wherein the processor processes the information output from the seeker to provide bang-bang control of the plurality of control surfaces to guide the guided projectile to the associated target.

Another aspect of the invention relates to a guided projectile including: a cylindrical body having a first axis and a second axis, wherein the first axis is perpendicular to the second axis; a plurality of control surfaces having a length and a width, wherein the each of the plurality of control surfaces are tangentially secured across a surface of the cylindrical body such the length of each of the plurality of control surfaces is substantially perpendicular to the first major axis and the width of each of the plurality of control surfaces is substantially perpendicular to the second major axis in a neutral position; a receiver housed within a portion of the cylindrical body, wherein the receiver guides the guided projectile to an associated target and the receiver outputs information related to a relative position between the guided projectile and the associated target; and a processor operatively coupled to the receiver and the plurality of control surfaces wherein the processor processes the information output from the receiver to provide bang-bang control of the plurality of control surfaces to guide the guided projectile to the associated target.

Another aspect of the invention relates to a method for controlling a guided projectile having a plurality of control surfaces mounted tangentially across a surface of a body the guided projectile and normal to a major axis of the guided projectile, the method including: receiving signals for guiding the guided projectile to an associated target; outputting information related to a relative position between the guided projectile and the associated target; processing the information to provide bang-bang control of the plurality of control surfaces through a plurality of actuators, wherein each of the plurality of control surfaces is operably coupled to one of the plurality of actuators to direct the guided projectile to the associated target; and deflecting at least one of the control surfaces to direct the guided projectile to the associated target.

One aspect of the invention relates to a guided projectile including: a body having a circular cross-section in at least a portion of the body; a plurality of actuators housed at least partially within the body; a plurality of control surfaces, wherein each control surface is secured to one of the plurality of actuators and the plurality of control surfaces are tangentially mounted about the cross-section of the body and each of the actuators are configured to impart a positive deflection on one of the control surfaces; a seeker housed within the head portion to detect electromagnetic radiation for guiding the guided projectile, wherein the seeker outputs information related to distance and/or direction of the detected electromagnetic radiation; and a processor coupled to the seeker and the plurality of actuators, wherein the processor processes the information output from the seeker to provide bang-bang control of the plurality of control surfaces to guide the guided projectile to an associated target.

Another aspect of the invention relates to a guided projectile including: a cylindrical body having a first axis and a second axis, wherein the first axis is perpendicular to the second axis; a plurality of control surfaces having a length and a width, wherein the each of the plurality of control surfaces are tangentially secured across a surface of the cylindrical body such the length of each of the plurality of control surfaces is substantially perpendicular to the first major axis and the width of each of the plurality of control surfaces is substantially perpendicular to the second major axis in a neutral position; a seeker housed within a portion of the cylindrical body, wherein the seeker is configured to detect electromagnetic radiation for guiding the guided projectile to an associated target and the seeker outputs information related to the detected electromagnetic radiation; and a processor operatively coupled to the seeker and the plurality of control surfaces wherein the processor processes the information output from the seeker to provide bang-bang control of the plurality of control surfaces to guide the guided projectile to the associated target.

Another aspect of the invention relates to a method for controlling a guided projectile having a plurality of control surfaces mounted tangentially across a surface of a body the guided projectile and normal to a major axis of the guided projectile, the method including: detecting electromagnetic radiation from a laser source at a seeker; outputting information related to distance and/or direction of the detected electromagnetic radiation; processing the information to provide bang-bang control of the plurality of control surfaces through a plurality of actuators, wherein each of the plurality of control surfaces is operably coupled to one of the plurality of actuators to direct the guided projectile to an associated target; and deflecting at least one of the control surfaces to direct the guided projectile to the associated target.

The foregoing and other features of the invention are hereinafter more fully described and particularly pointed out in the claims, the following description and the annexed drawings setting forth in detail illustrative embodiments of the invention, such being indicative, however, of but a few of the various ways in which the principles of the invention may be employed.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION OF THE INVENTION

Figure 1A:
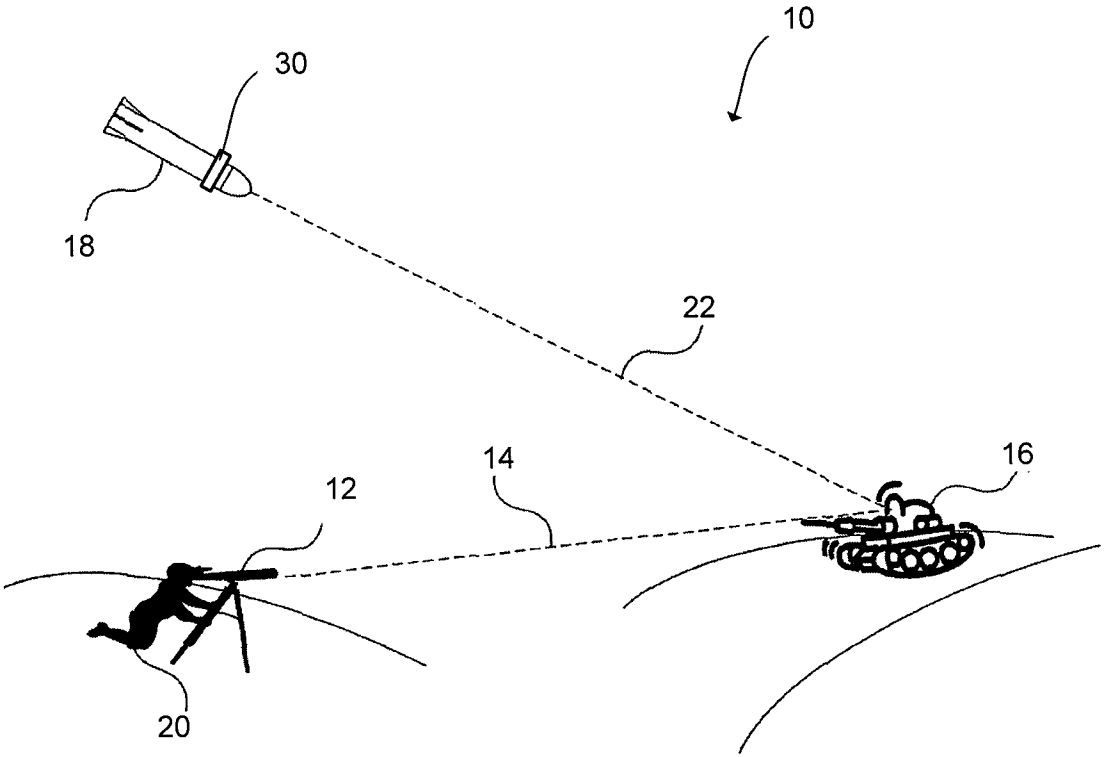
FIGS. 1A and 1B illustrate exemplary environmental views of various projectiles for use in accordance with aspects of the present invention.

FIG. 1A shows schematically a system 10 according to one aspect of the present invention. The system 10 includes a laser illuminator 12 for directing a laser beam 14 at and illuminating a target 16 and a guided projectile 18 having a target seeker device that detects the reflected electromagnetic radiation from the target 16 and the guided projectile 18 is operable to change course in flight based on the detected electromagnetic radiation 22 to strike the target 16. In one embodiment, an operator 20 directs the laser illuminator 20 at the target 16. The operator 20 may be positioned in any location (e.g., on the ground, in an aircraft that launches the guided projectile 18, etc.). The guided projectile 18 may be fired from a launcher (not shown) or another source and the target seeker device in the guided projectile 18 detects the reflected electromagnetic radiation 22 from the target by means of a detector. The guided projectile homes on such reflected illumination by means of the laser target seeker device intercepts and destroys the target 16.

Figure 1B:
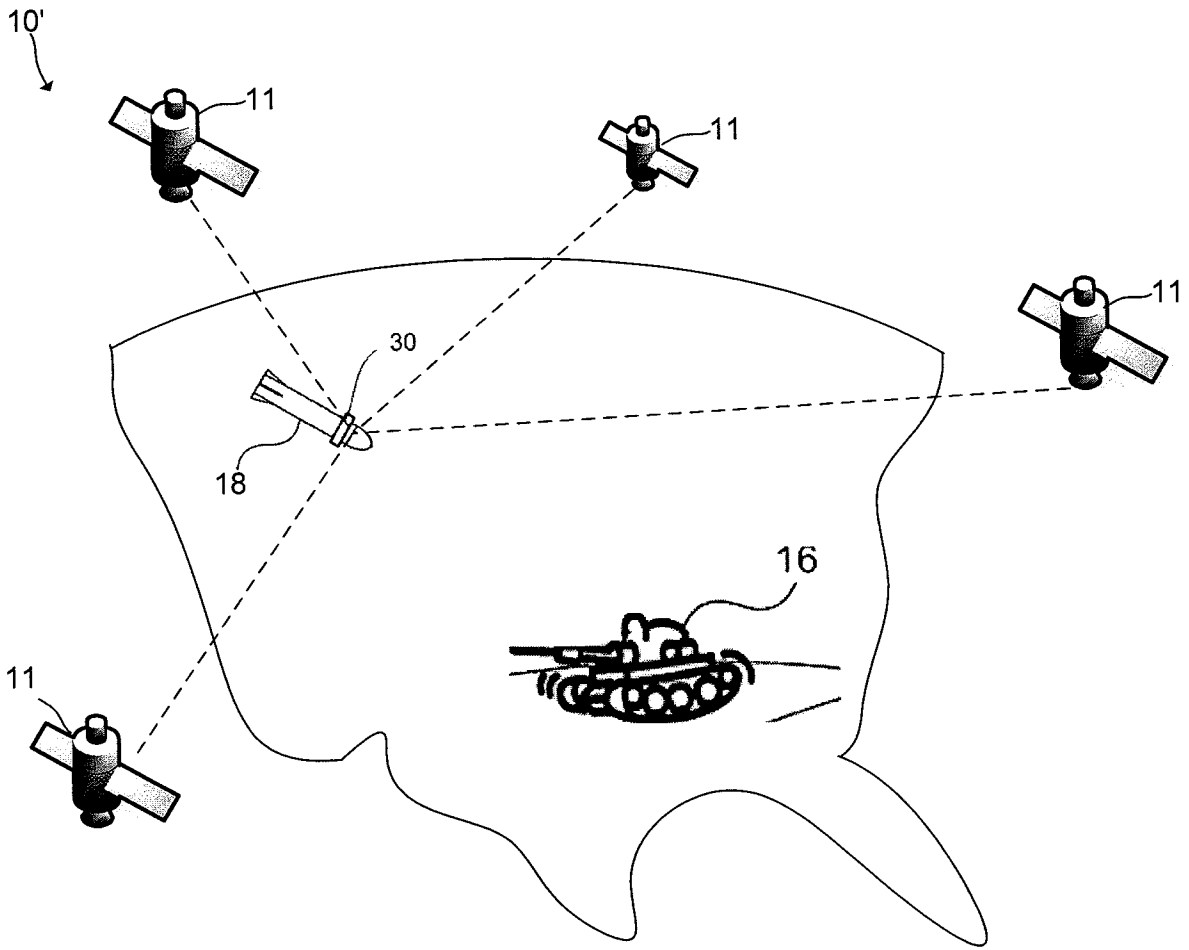

FIG. 1B shows schematically another system 10' according to another aspect of the present invention. The system 10' includes a guided projectile 18 that includes a positioning receiver (e.g., GPS or other navigation system receiver) that receives signals from a plurality of positioning satellites 11. The positioning receiver is operable to output control information to direct the guided projectile 18 to change course in flight based on location of the projectile 18 and/or the target 16 in order for the guided projectile 18 to strike the target 16. In one embodiment, the receiver periodically acquires positioning information from the positioning satellites 11. The guided projectile 18 may be fired from a launcher (not shown) or another source and the positioning receiver directs the guided projectile 18 to intercept and destroy the target 16.

Portions of this disclosure identify GPS as an example of an applicable positioning/navigation technology. However, this description is not intended to limit the invention to GPS receivers. Other positioning technologies such as Russian GLONASS, China COMPASS, Europe Galileo, and India IRNSS are also deemed to be within the scope of the present invention.

Figure 2:
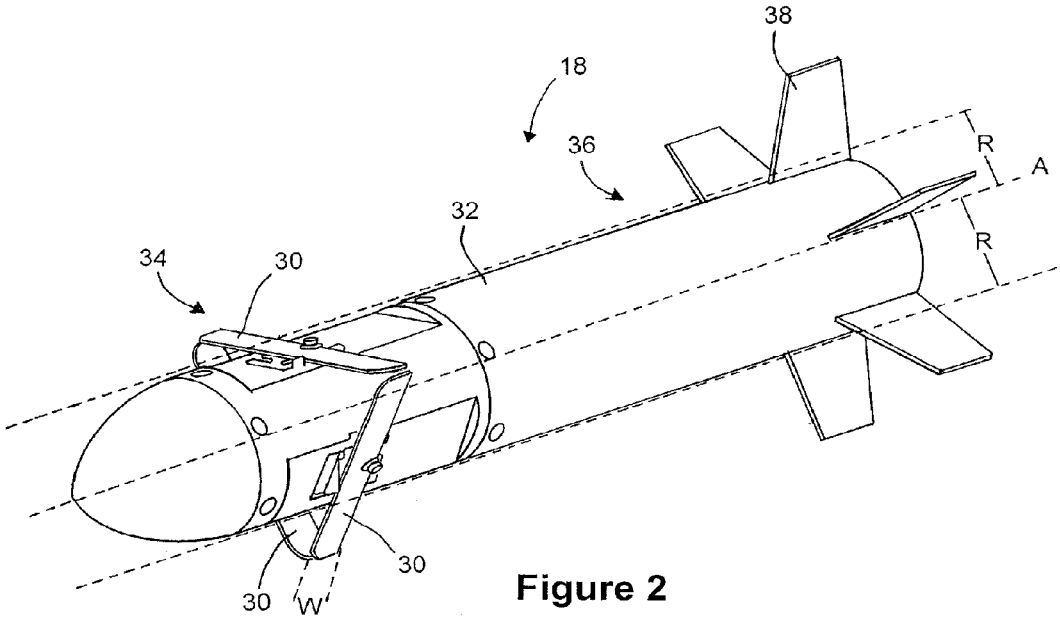
FIG. 2 is a perspective view of an exemplary guided projectile in accordance with aspects of the present invention.

Referring now to FIG. 2, an exemplary guided projectile 18 in accordance with aspects of the invention is illustrated. The guided projectile 18 generally includes a plurality of control surfaces 30 for controlling direction of the guided projectile 18. The control surfaces may also be referred to herein as "canards". The control surfaces 30 are mounted about the body 32 of the guided projectile 18. The body 32 of the guided projectile is generally shaped like a conventional missile. As such, the body 32 is generally cylindrically shaped having a primary axis (A) along the length of the guided projectile and a radius (R) extending from the primary axis to the outer curved surface of the body 32, as illustrated in FIG. 2. The body 32 may include a forward body 34 coupled to an aft tail assembly 36 that includes one or more fins 38.

The control surfaces 30 may be any desired size and shape. In general, the control surfaces 30 are substantially planar and have a length (L), a width (W) and a thickness (T). The width (W) should be sufficient to provide adequate deflection of the guided projectile 18 to guide the projectile when deployed. The thickness (T) should be sufficient to ensure that the control surface may be adequately attached to an actuator, discussed below, as well as ensuring that the control surfaces do not deform when deployed at high speeds. Preferably, the length (L) of the control surfaces 30 is sufficient to form a desired shape. For example, as illustrated in FIGS. 2 and 3, the control surfaces 30 are configured to form an equilateral triangle. Other configurations are also deemed to fall within the scope of the present invention. For example, the control surfaces may also be configured to form a square, diamond, hexagon, octagon or other shape that may be desired. Such shapes may be symmetrical and/or asymmetrical. Preferably, the control surfaces used are in the shape of an equilateral triangle or a square.

Figure 3A:
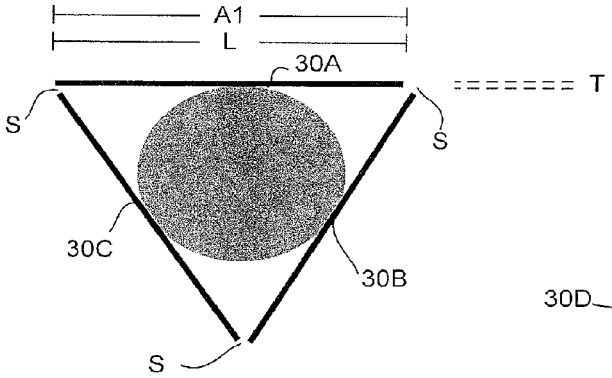
FIG. 3A is a cross-sectional view of the guided projectile of FIG. 2.

As shown in FIGS. 2 and 3A, the control surfaces 30 may be spaced relative to each other to form an equilateral triangle. One benefit with the symmetrical nature of an equilateral triangle is that each panel has an equal span (e.g., length), which enables the force generated by two panels that are deflected to be equal and opposite to that of the opposing panel, as discussed below. In such case, the lift force generated by the control surfaces is generated through a centerline axis of the projectile. This provides a combination of 6 force vectors to guide the guided projectile 18. Another benefit is that the 6 force vectors are created using only 3 actuators and control surfaces. Sizing the control surfaces to form an equilateral triangle gives each surface equal span, and enables the force generated by two panels to be equal and opposite to that of the opposing panel. The end effect is that each panel only has two active states (neutral (0 deflection) and positive deflection), (neutral (0 deflection) and negative deflection) or (positive deflection and negative deflection. Thus, a solenoid and a return spring (or other return mechanism) may be used to control deflection of the control surfaces.

Figure 3B:
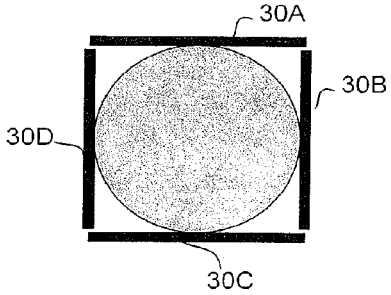
FIG. 3B is a cross-sectional view of another embodiment of the present invention.

A similar benefit may result with the control surfaces 30A-30D configured in the shape of a square, as illustrated in FIG. 3B. In such case, 8 force vectors may be created using only 4 actuators and control surfaces 30A-30D. Many of the same benefits associated with the equilateral triangle are also obtained with a square configuration, as discussed above. The remainder of this disclosure will discuss the equilateral triangle embodiment, however, one skilled in the art will readily appreciate the concepts discussed herein are applicable to a square control surface configuration illustrated in FIG. 3B and other configurations.

Referring back to FIG. 2, the control surfaces 30 may be secured to the forward body 34 of the guided projectile 18 or the aft tail assembly 36 having fins 37. As illustrated in FIG. 2, preferably the control surfaces 30 are secured on a portion of the forward body 34. The control surfaces 30 are used for controlling orientation and course of the guided projectile 18. Thus, the control surfaces 30 may be coupled to other devices in the body 32. For example, the control surfaces 30 may be coupled to an inertia measuring unit and actuators 40 to aid in determining and guiding the course of the guided projectile 18, and the proper positioning for the control surfaces 30, as discussed below, in guiding that course.

As illustrated in FIG. 2, the plurality of control surfaces 30 are mounted about the cross-section of the body 32 in a manner such that each control surface is tangentially mounted about a surface of the body 32. The term "tangent" is not to be used herein in a strict mathematical or geometric sense. As used herein "tangentially mounted about a surface of the body" means the control surfaces have a primary axis (A1) that extends substantially perpendicular to the primary axis (A) of the guided projectile 18 and the control surface forms an outer surface of the guided projectile. As illustrated, the control surfaces 30 are mounted such that the length (L) of the control surface is substantially normal to the first axis (A) of the body and the width (W) is aligned in a parallel arrangement with the first axis (A).

Referring to FIG. 3A, the control surfaces 30A-30C are configured generally in the shape of an equilateral triangle around a forward portion of the guided projectile 10. As shown in FIG. 3, there are spaces (S) between each of the control surfaces (30A-30C). For purposes of this disclosure, the shape is considered an equilateral triangle since each of the control surfaces are the same size and shape and the control surfaces substantially form an equilateral triangle. The control surfaces 30A-30C may be in contact with one another or spaces (S) may be adjacent the control surfaces, as depicted in FIG. 3A.

Figure 4:
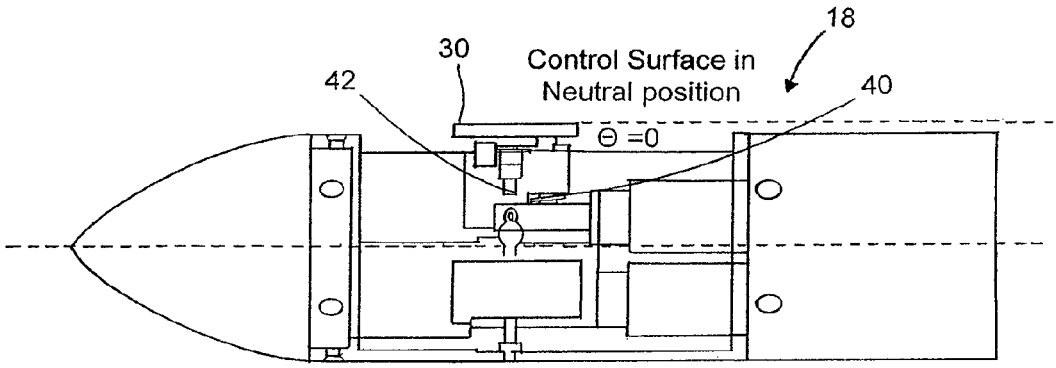
FIGS. 4-6 are exemplary side views of guided projectile illustrated in FIG. 2.
Figure 5:
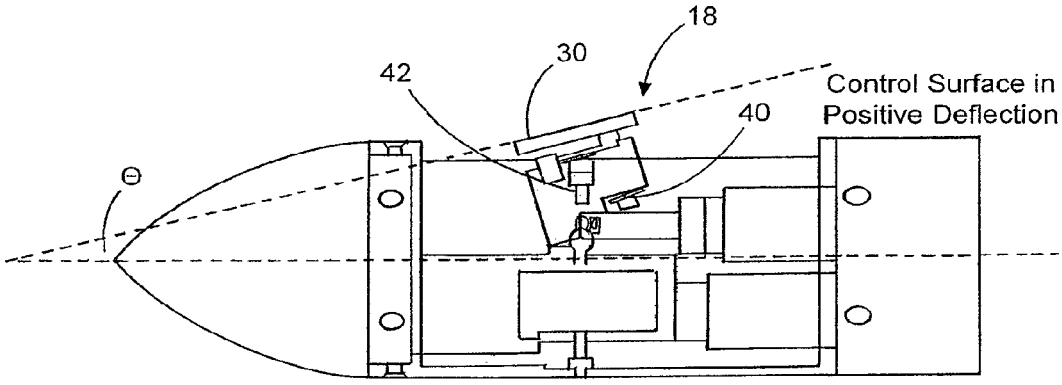

Referring to FIGS. 4 and 5, each of the plurality of control surfaces 30 are secured to an actuator 40. Preferably, the actuators 40 may be a solenoid, which is particularly suitable for bang-bang control operation, as discussed below. A solenoid is a device that converts energy into linear motion. This energy may come from an electromagnetic field, a pneumatic (air-powered) chamber or a hydraulic (fluid-filled) cylinder. When a solenoid is utilized to impart deflection, a return mechanism 42, e.g., a compression spring may be utilized to return the control surface 30 from a deflected position to a neutral position or vice versa. A plurality of springs may be utilized to return the control surface 30 from a deflected position to the neutral position or vice versa.

Figure 6:
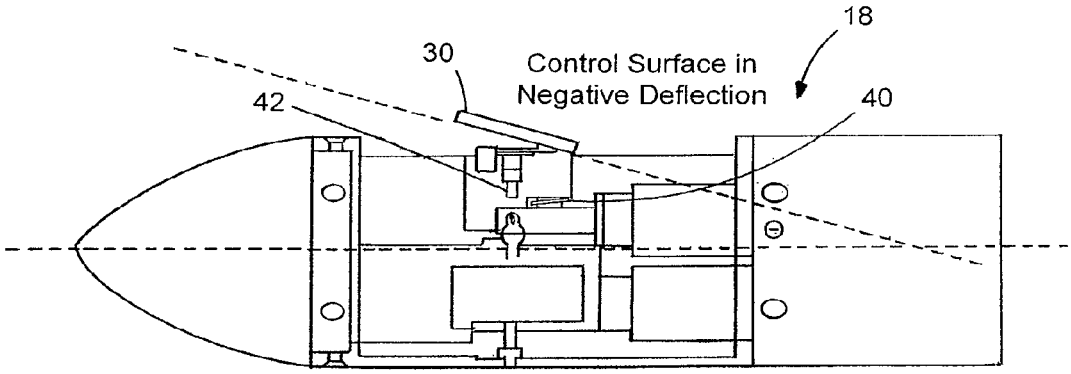

Referring to FIG. 4, an actuator 40 coupled to the control surface 30 is illustrated in a neutral position. In a neutral position, the control surface 30 does not impart any substantial deflection to the guided projectile 18 when traversing through the air. An actuator 40 may also be configured to impart a positive deflection on one of the control surfaces, as illustrated in FIG. 5. A positive deflection occurs when the actuator 42 causes the control surface to move from a neutral position, which is generally parallel to the axis (A) of the body 12, as illustrated in FIG. 4, to an extended position, as illustrated in FIG. 5. The actuator 40 may also place the control surface 30 in a negative deflection position, as illustrated in FIG. 6.

For positive deflection, the control surface 30 is an extended position. The extended position occurs when a portion of the control surface 30 is deflected such that the planar surface of the control surface 30 is not parallel with the primary axis (A) of the guided projectile 18 and a forward portion of the control surface 30 aligned closer to the body 32 than an aft portion of the control surface 30. For example, the width (W) dimension of the control surface is changed from a neutral position (parallel with the first axis (A) of the body) to a non-parallel or deflected position. This occurs when the aft portion of the control surface 30 is positively deflected outward from the body 32 and the forward portion of the control surface 30 is deflected toward the body 32.

For negative deflection, the control surface 30 is an inverted position, as compared to the extended position. For example, in the inverted position, a portion of the control surface 30 is deflected such that the planar surface of the control surface 30 is not parallel with the primary axis (A) of the guided projectile 18 and an aft portion of the control surface 30 aligned closer to the body 32 than a forward portion of the control surface 30.

Generally, the control surface 30 will be deflected a prescribed deflection angle θ. For example, the control surface 30 will be deflected a prescribed deflection angle θ. The deflection angle θ may vary depending on a variety of factors including, for example, size of the guided projectile, type of actuator used, type of control system, ballistic range, etc. A suitable deflection angle may be in the range of 3-20 degrees, for example.

While neutral, positive and negative deflection of the control panels are contemplated within the scope of this invention, an actuator 40 utilizing bang-bang control is operable to place the control panel in only two positions. For example, the actuator may be configured to place the control panel 30 in a positive deflection position and neutral position, in a negative deflection position and neutral position; or in a positive deflection position and a negative deflection position.

Figure 7:
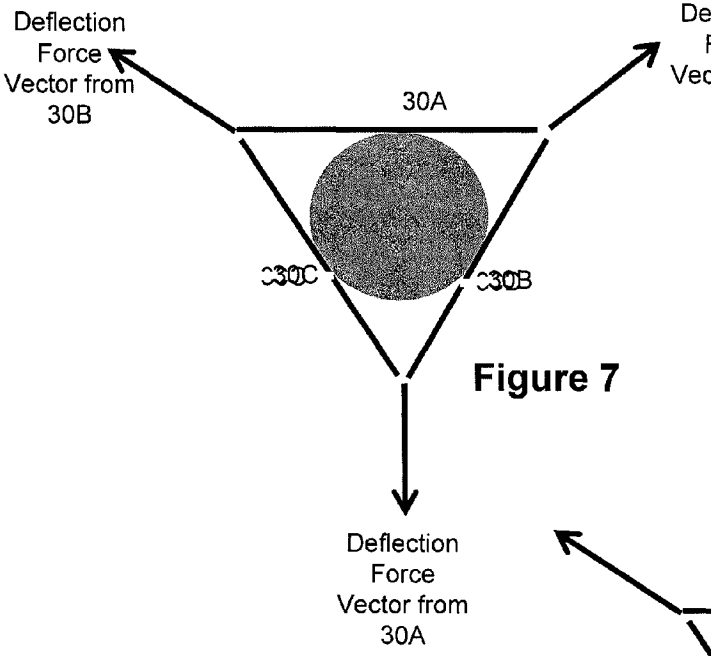
FIGS. 7-9 are exemplary deflection force vector diagrams in accordance with aspects of the present invention.

As discussed above, the guided projectile 18 includes a plurality of control surfaces 30 that are secured around the periphery of the body 32 in a manner to form an equilateral triangle. There are substantial advantages to the symmetry of an equilateral triangle. For example, referring to FIG. 7, deflection of one of the plurality of control surfaces (e.g., control surface 30A) results in a deflection force vector substantially normal to the deflected control surface. FIG. 7 illustrates deflection forces for deflection of each of the control surfaces 30A-30C.

Figure 8:
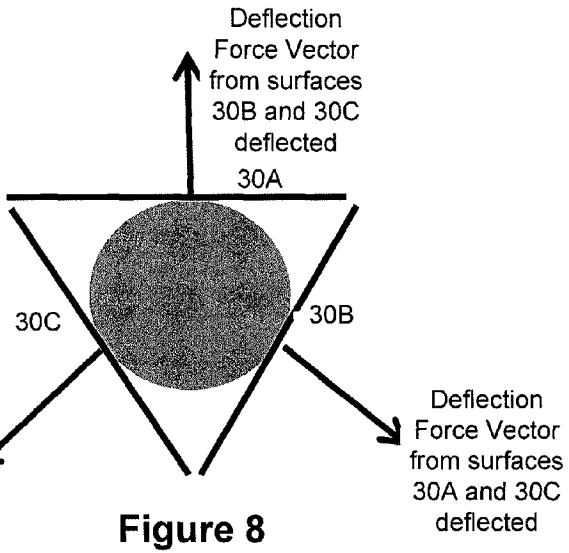
Figure 9:
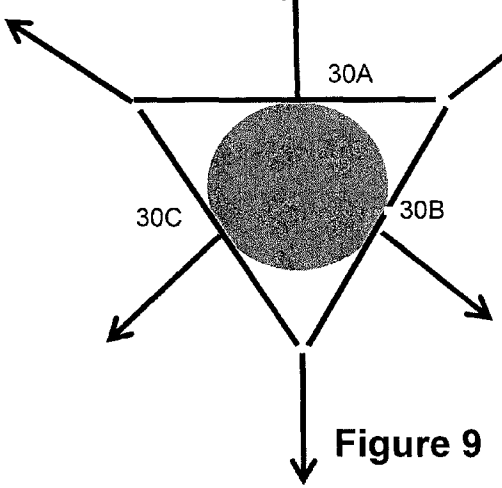

Likewise, deflection of two of the plurality of control surfaces (e.g., 30A and 30B) results in a deflection force vector substantially normal to a third control surface (30C), as illustrated in FIG. 8. Thus, the control surfaces 30A-30C arranged in an equilateral triangle provide six identical equally spaced resultant force vectors directed through a longitudinal axis of the body 32, as illustrated in FIG. 9. Another benefit of such a configuration is that deflection of one of the plurality of control surfaces 30A-30C does not impart a rolling motion to the guided projectile 18.

Figure 10:
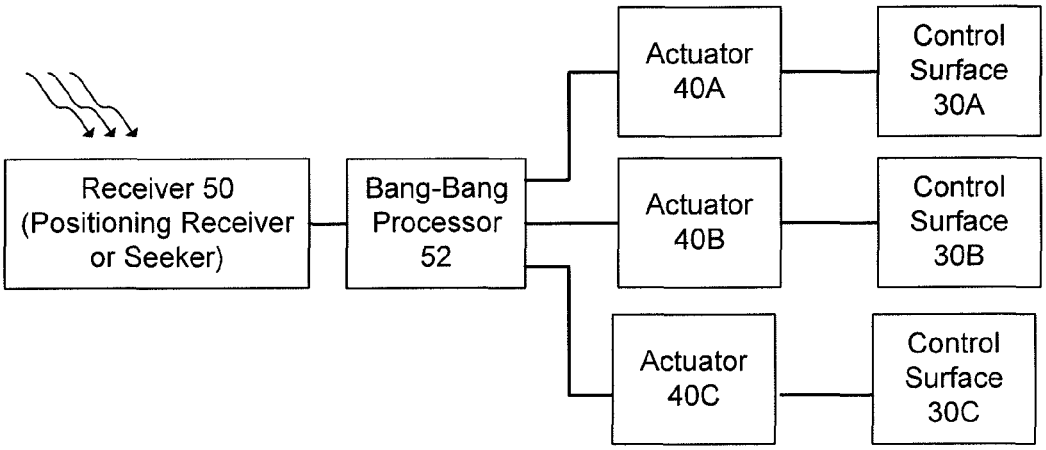
FIG. 10 is an exemplary system block diagram in accordance aspects of the present invention.

The guided projectile 18 also includes a seeker 50 or a positioning receiver 50 that is operatively coupled to the control surfaces 30 through the actuators 40, as illustrated in FIG. 10. In general, depending on the technology, the seeker 50 maintains acquisition of the target 16 (or desired destination point), and outputs information to the to a processor 52 which processes the received information and outputs appropriate control signals to the actuators 42A-42C to adjust the control surfaces 30A-30C in order to put the guided projectile 18 on a course for reaching its desired destination.

The seeker 50 operates by remaining pointed or otherwise acquiring a desired target or other destination point. Alternatively, the seeker 50 may acquire a point other than an intended destination, but which aids in guidance of the projectile 18 to its intended destination. The seeker 50 may be mounted on a gimbal (not shown) to allow the seeker 50 to move as relative orientation between the guided projectile 18 and the target 16 or destination changes.

The seeker 50 may be any of a variety of known terminal seekers. Two broad categories of terminal seekers are imaging infrared (IIR) seekers and millimeter wave radio frequency (MMW) seekers. In addition to the broad categories of seekers mentioned above, it will be appreciated that any of a wide variety of seekers may be utilized with the control surface configuration described above.

As described above, in the case where the guided projectile 18 includes a positioning receiver for guiding the projectile, the positioning receiver receives positioning signals from the positioning satellites 11 and the positioning receiver outputs appropriate control signals to the actuators 40A-40C to adjust the control surfaces 30A-30C in order to put the guided projectile 18 on a course for reaching its desired destination.

It will be appreciated that the forward body 12 may include other types of components other than those mentioned above. For example, the forward body 12 may include a payload 54, such as a suitable projectile. In addition, the forward body 12 may include communication devices for actively or passively communicating with remote tracking and/or guidance devices, for example.

As discussed with respect to FIG. 1, guidance of embodiments of projectiles according to the present invention comprises a laser designating a target and receiving the laser's light reflected from the target by the seeker 50, as well as location based targeting. Electrical signals (also referred to herein as information) output from the seeker 50 and/or positioning receiver 50 can be processed by an ASIC (Application Specific Integrated Circuit) or similar processor 52 for generating the control commands for the electromagnetic actuators driving the control surfaces 30. Preferably, the processor 52 implements "bang-bang" control for embodiments of the present invention. This approach to a guidance system can be used to deflect the control surfaces 30 to their maximum deflection. As is well known in the art, the term "bang-bang" implies two control states for each actuator. The actuator 40 may be configure for full deflection or no deflection for each of the control surfaces, negative deflection or no deflection for each of the control surfaces or full deflection and negative deflection for each of the control surfaces. For example, if an actuator 40 is triggered, the full deflection (e.g., positive or negative) of the actuator may be imparted to the corresponding control surface 30. For example, if the full deflection for a given actuator is 10 degrees to maintain alignment of the projectile's longitudinal axis with the instantaneous line-of-sight to the target, the full 10 degrees is imparted in the control surface 30. As opposed to proportional navigation, "bang-bang" control is preferred in this embodiment because of inherent performance advantages of the guided projectile's small scale and the low cost of such controllers. As the size of a flight vehicle is reduced, the aerodynamic frequency increases inversely with its scale. As a result, the response of the guided projectile to guidance commands will improve nearly two orders of magnitude relative to a 1000 lb guided bomb. This improved response allows the use of less complex guidance systems (e.g. "bang-bang") that can be more easily accommodated within the tight spatial confines of a small caliber projectile, while providing adequate targeting performance.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. A guided projectile comprising:

a body having a circular cross-section in at least a portion of the body;

a plurality of actuators housed at least partially within the body;

a plurality of control surfaces, wherein each control surface is secured to one of the plurality of actuators and the plurality of control surfaces are tangentially mounted about the cross-section of the body and each of the actuators are configured to impart a positive deflection on one of the control surfaces a receiver housed within the head portion to for guiding the guided projectile, wherein the receiver outputs information related to a relative position between the guided projected and an associated target; and a processor coupled to the seeker and the plurality of actuators, wherein the processor processes the information output from the seeker to provide bang-bang control of the plurality of control surfaces to guide the guided projectile to the associated target.

2. The guided projectile of claim 1, wherein each of the plurality of actuators are solenoids that are configured to provide positive deflection of one of the control surfaces to the guided projectile.

3. The guided projectile of claim 2, additionally including a return mechanism for returning the one of the control surfaces to a position of neutral deflection.

4. The guided projectile of claim 3, wherein the return mechanism is a spring operably coupled to one of the control surfaces to return the one of the control surfaces to a position of neutral deflection.

5. The guided projectile of claim 1, wherein the plurality of control surfaces are secured in a manner to form an equilateral triangle.

6. The guided projectile of claim 5, wherein the plurality of control surfaces are configured to provide six identical equally spaced resultant force vectors directed through a longitudinal axis of the body.

7. The guided projectile of claim 5, wherein deflection of one of the plurality of control surfaces results in a deflection force vector substantially normal to the deflected control surface.

8. The guided projectile of claim 5, wherein deflection of two of the plurality of control surfaces results in a deflection force vector substantially normal to a third control surface.

9. The guided projectile of claim 5, wherein deflection of one of the plurality of control surfaces does not impart a rolling motion to the guided projectile.

10. The guided projectile of claim 1, wherein the receiver is a seeker housed within the head portion to detect electromagnetic radiation for guiding the guided projectile, wherein the seeker outputs information related to distance and/or direction of the detected electromagnetic radiation.

11. The guided projectile of claim 10, wherein the receiver is a laser seeker.

12. The guided projectile of claim 1, wherein the receiver is a positioning receiver configured to receive signals from a plurality of associated positioning satellites.

13. A guided projectile comprising:

a cylindrical body having a first axis and a second axis, wherein the first axis is perpendicular to the second axis;

a plurality of control surfaces having a length and a width, wherein the each of the plurality of control surfaces are tangentially secured across a surface of the cylindrical body such the length of each of the plurality of control surfaces is substantially perpendicular to the first major axis and the width of each of the plurality of control surfaces is substantially perpendicular to the second major axis in a neutral position;

a receiver housed within a portion of the cylindrical body, wherein the receiver guides the guided projectile to an associated target and the receiver outputs information related to a relative position between the guided projectile and the associated target; and a processor operatively coupled to the receiver and the plurality of control surfaces wherein the processor processes the information output from the receiver to provide bang-bang control of the plurality of control surfaces to guide the guided projectile to the associated target.

14. The guided projectile of claim 13 further including a plurality of actuators at least partially housed within a portion of the cylindrical body, wherein each of the plurality of actuators are coupled to one control surface of the plurality of control surfaces.

15. The guided projectile of claim 14, wherein each of the plurality of actuators are solenoids that are configured to provide positive deflection of one of the control surfaces to the guided projectile.

16. The guided projectile of claim 15, additionally including a return mechanism coupled operably coupled to one of the control surfaces, wherein the return mechanism is operable to return a deflected control to a position of neutral deflection.

17. The guided projectile of claim 13, wherein the plurality of control surfaces are secured in a manner to form an equilateral triangle.

18. The guided projectile of claim 17, wherein the plurality of control surfaces are configured to provide six identical equally spaced resultant force vectors directed through a longitudinal axis of the body.

19. The guided projectile of claim 18, wherein deflection of one of the plurality of control surfaces results in a deflection force vector substantially normal to the deflected control surface.

20. The guided projectile of claim 18, wherein deflection of two of the plurality of control surfaces results in a deflection force vector substantially normal to a third control surface.

21. A method for controlling a guided projectile having a plurality of control surfaces mounted tangentially across a surface of a body the guided projectile and normal to a major axis of the guided projectile, the method comprising:

receiving signals for guiding the guided projectile to an associated target;

outputting information related to a relative position between the guided projectile and the associated target;

processing the information to provide bang-bang control of the plurality of control surfaces through a plurality of actuators, wherein each of the plurality of control surfaces is operably coupled to one of the plurality of actuators to direct the guided projectile to the associated target; and deflecting at least one of the control surfaces to direct the guided projectile to the associated target.

22. The method of claim 21, wherein each of the plurality of actuators is a solenoid that is configured to impart a deflection of one of the plurality of control surfaces.

23. The method of claim 22, further including a return mechanism for returning a deflected control surface to a neutral position with respect to the guided projectile.

* * * * *